US011000103B2

(12) United States Patent
Grienay et al.

(10) Patent No.: US 11,000,103 B2
(45) Date of Patent: May 11, 2021

(54) HAIR STYLING APPLIANCE COMPRISING A REMOVABLE RESERVOIR

(71) Applicant: SEB S.A., Ecully (FR)

(72) Inventors: Arnaud Grienay, Lyons (FR); Laurent Livet, Tersanne (FR); Martial Maisonneuve, Villefontaine (FR); Baptiste Bonnemaire, Lyons (FR)

(73) Assignee: SEB S.A.

( * ) Notice: Subject to any disclaimer, the term of this patent is extended or adjusted under 35 U.S.C. 154(b) by 211 days.

(21) Appl. No.: 16/307,391

(22) PCT Filed: Jun. 2, 2017

(86) PCT No.: PCT/FR2017/051403
§ 371 (c)(1),
(2) Date: Dec. 5, 2018

(87) PCT Pub. No.: WO2017/212154
PCT Pub. Date: Dec. 14, 2017

(65) Prior Publication Data

US 2019/0191841 A1 Jun. 27, 2019

(30) Foreign Application Priority Data

Jun. 6, 2016 (FR) ..... 1655172

(51) Int. Cl.
*A45D 1/04* (2006.01)
*A45D 1/06* (2006.01)
(Continued)

(52) U.S. Cl.
CPC ..... *A45D 1/04* (2013.01); *A45D 1/06* (2013.01); *A45D 2/001* (2013.01); *A45D 2001/008* (2013.01); *A45D 2200/05* (2013.01)

(58) Field of Classification Search
CPC . A45D 1/04; A45D 1/06; A45D 2/001; A45D 2001/008; A45D 2200/05
See application file for complete search history.

(56) References Cited

U.S. PATENT DOCUMENTS 7,772,526 B2 * 8/2010 Chuong ..... A45D 20/12 219/385
9,149,102 B2 * 10/2015 Fereyre ..... A45D 1/04
(Continued)

FOREIGN PATENT DOCUMENTS

EP 2 449 912 A1 5/2012

OTHER PUBLICATIONS

International Search Report as issued in International Patent Application No. PCT/FR2017/051403, dated Jul. 25, 2017.

*Primary Examiner* — Nicholas D Lucchesi
(74) *Attorney, Agent, or Firm* — Lerner, David, Littenberg, Krumholz & Mentlik, LLP

(57) ABSTRACT

A hair styling appliance includes a base including a mount and a removable reservoir configured to take up a disconnected position in which the reservoir is away from the mount and an operating position in which the reservoir engages fluidically with the mount, a portable unit remote from the base; a line that fluidically connects the base and the portable unit; wherein the base also includes a detection system having a detector configured to detect the passage of the reservoir from the disconnected position to the operating position.

11 Claims, 3 Drawing Sheets

(51) Int. Cl.
*A45D 2/00* (2006.01)
*A45D 1/00* (2006.01)

(56) References Cited

U.S. PATENT DOCUMENTS

| | | | | |
|---|---|---|---|---|
| 10,026,296 | B2 * | 7/2018 | Fateh | A45D 40/18 |
| 10,485,319 | B2 * | 11/2019 | Fereyre | A45D 2/001 |
| 10,517,365 | B2 * | 12/2019 | Ngo | A45D 2/001 |
| 2012/0111355 | A1 * | 5/2012 | Vacheron | A45D 1/04 132/228 |

* cited by examiner

HAIR STYLING APPLIANCE COMPRISING A REMOVABLE RESERVOIR

CROSS-REFERENCE TO RELATED APPLICATIONS

This application is the U.S. National Stage of International Application Serial No. PCT/FR2017/051403, filed Jun. 2, 2017, which in turn claims priority to French Application No. 1655172, filed Jun. 6, 2016. The contents of all of these applications are incorporated herein by reference in their entirety.

This invention concerns a hair styling appliance using steam and intended to shape hair by contact, intended in particular for straightening, curling or crimping the hair of a user.

Two traditionally known types of hair styling appliances for straightening, curling or crimping have hair clamping surfaces that are flat, curved or uneven, and are heated or heating.

Hair styling appliances like straightening, curling or crimping irons generally comprise a portable unit with two pivoting jaws. The jaws each comprise an extremity supporting a treatment surface, at least one of the treatment surfaces being heated, the other being provided to bring the hair into contact with the first surface, in particular by moving from an open position of the jaws, allowing the hair to be inserted, to a closed position for putting the hair into contact with the heating part.

The other extremity of the jaws forms two handle halves acting as a gripping area and making it possible to move from the open position to the closed position. The movement is performed manually by pressing the two articulated handle halves of the appliance towards one another to bring the treatment surfaces into contact with the hair. A strand of hair is straightened by moving the appliance along this strand, from the root to the end. A strand of hair is curled by winding the strand at least partially around the treatment surface(s) and applying heat to set the curl primarily statically.

In such appliances, it is envisioned to also use steam sprayed onto the hair in order to improve the shaping of the hair.

To improve the steaming capacity of the hair styling appliance, it is known, in particular from the document EP2449912, to separate the storage means for the fluid used to produce the steam. The hair styling appliance thus comprises a base with a removable reservoir intended to store the fluid. After filling the reservoir, the user attaches it to a mount of the base in order to allow a fluid connection between the mount and the reservoir. The mount of the base comprises a suction/discharge device for carrying the fluid towards fluid steaming means arranged in the portable unit of the hair styling appliance.

However, the fluid connection between the reservoir and the mount is sometimes poorly executed. In fact, the user may fail to position the reservoir correctly so that it is in sealed fluid communication with the mount. The steaming capacity of the hair styling appliance is then not optimal, and the efficacy of the appliance is affected by this. In addition, a poor fluid connection or a non-sealed fluid connection could damage the appliance and cause malfunctions.

The goal of this invention is to remedy all or a portion of the aforementioned drawbacks. To this end, this invention concerns a base of a hair styling apparatus comprising:

a mount;

a removable reservoir configured to be in a disconnected position in which the reservoir is away from the mount, and an operating position in which the reservoir engages fluidically with the mount, characterized in that the base further comprises a detection system with a detector configured to detect the movement of the reservoir from the disconnected position to the operating position.

Thanks to the provisions according to the invention, the detection of the movement of the reservoir from the disconnected position to the operating position is accurate. The accuracy of this detection of the position of the reservoir provides more safety for the user when putting the hair styling appliance, and more specifically the base, into operation. In addition, the provisions according to the invention reduce the risk of malfunctions and deterioration of the hair styling appliance.

"Disconnected position" refers to a position of the reservoir in which the reservoir is away from the mount, that is, fluidically disconnected from the mount.

According to one aspect of the invention, the detection system comprises an information transmission device configured to communicate information to a user on the movement of the reservoir from the disconnected position to the operating position.

Thanks to these provisions, the user is notified of the movement of the reservoir from the disconnected position to the operating position. The information to the user is accurate and thus facilitates the use of the hair styling appliance. In addition, the risks associated with the use of the appliance when there is a non-sealed connection between the base and the mount are limited.

According to one aspect of the invention, the base comprises a fluid suction/discharge device, the detection system comprising a control interface configured to prevent the suction/discharge device from starting up when the reservoir is in the disconnected position.

According to one aspect of the invention, the base comprises a fluid suction/discharge device, the detection system comprising a control interface configured to control the suction/discharge device in order to prevent the suction/discharge device from starting up when the reservoir is in the disconnected position.

Thanks to these provisions, if the reservoir is not in sealed fluid communication with the mount, the suction/discharge device cannot start up. The risks of damage to the device are thus limited. More specifically, the mount comprises the suction/discharge device.

According to one aspect of the invention, the control interface is configured to control the suction/discharge device in order to permit the suction/discharge device to start up when the reservoir is in the operating position, and more specifically when the detector detects the movement of the reservoir from the disconnected position to the operating position.

According to one aspect of the invention, the control interface is configured to start up the suction/discharge device when the reservoir is in the operating position, and more specifically when the detector detects the movement of the reservoir from the disconnected position to the operating position.

According to one aspect of the invention, the detector is designed to transmit information to the information transmission device and/or to the suction/discharge device on the movement from the disconnected position to the operating position.

According to one embodiment of the invention, the suction/discharge device consists of a pump.

According to one aspect of the invention, the control interface is configured to control the information transmission device.

"Detector" refers to all types of proximity sensors, such as mechanical detectors, electrical contact detectors, magnetic or electromagnetic detectors, infrared radiation detectors.

According to one aspect of the invention, the detector comprises a detection member able to move between a resting position and a biasing position, corresponding to the movement of the reservoir from the disconnected position to the operating position; and a biasing member designed to move the detection member between the resting position and the biasing position.

These provisions concern a mechanical detector, not subject to malfunctions associated with electronics. In addition, a mechanical detector is less sensitive to aqueous contact.

According to one aspect of the invention, the detection member comprises a return element designed to return the detection member to the resting position.

According to one aspect of the invention, the return element comprises an elastically deformable element.

According to one aspect of the invention, the detector comprises a metal strip.

According to one aspect of the invention, the metal strip comprises an extremity portion fixed to the mount.

According to one aspect of the invention, the metal strip comprises the return element.

According to one aspect of the invention, the metal strip comprises the detection member.

According to one aspect of the invention, the return element comprises a spring.

According to one aspect of the invention, the detection member is attached to the return element.

According to one aspect of the invention, the detection member is made in one piece with the return element.

According to one aspect of the invention, the detection member comprises a guiding surface of the biasing member.

According to one aspect of the invention, the biasing member is designed to drive the detection member from the resting position to the biasing position.

According to one aspect of the invention, the biasing member is integral with the reservoir.

According to one aspect of the invention, the biasing member is made in one piece with the reservoir.

According to one aspect of the invention, the biasing member comprises a finger.

According to one aspect of the invention, the finger is designed to engage with the guiding surface.

According to one aspect of the invention, the finger is designed to slide along the guiding surface in order to drive the detection member from the resting position to the biasing position.

According to one aspect of the invention, the guiding surface comprises an extremity portion.

According to one aspect of the invention, the biasing member is configured to slide on the guiding surface towards the extremity portion. When the biasing member reaches the extremity portion, the detection member is in the biasing position.

According to one aspect of the invention, the biasing member is configured to cross the extremity portion and the return element returns the detection member to the resting position.

According to one aspect of the invention, the detector comprises a magnetic element. According to one embodiment, the detector comprises a magnetic switch, for example, a magnetic reed switch.

According to one embodiment, the detector comprises a Hall effect sensor.

According to one aspect of the invention, the detector comprises a wave transmitter and a wave receiver.

According to one aspect of the invention, the wave is infrared.

According to one aspect of the invention, the wave is an ultrasonic sound wave.

According to one aspect of the invention, the information transmission device comprises a sound wave generator.

According to one aspect of the invention, the sound wave generator is configured to transmit a sound wave when the reservoir moves from the disconnected position to the operating position.

According to one aspect of the invention, the sound wave generator comprises a movable part and a fixed part arranged opposite the movable part, the movable part being configured to come into contact with the fixed part in order to produce a click. The click generates a sound wave and thus notifies the user that the reservoir is correctly positioned on the mount.

According to one aspect of the invention, the movable part is integral with the return element.

According to one aspect of the invention, the return element is configured to return the movable part to the fixed part.

According to one aspect of the invention, the metal strip comprises the movable part of the sound wave generator.

According to one aspect of the invention, the fixed part is integral with the mount.

According to one aspect of the invention, the movable part is integral with the detection member.

According to one aspect of the invention, the return element is configured to return the detection member to the resting position, and the movable part to the fixed part in order to generate a click.

According to one aspect of the invention, the fixed part is made in one piece with the mount.

According to one aspect of the invention, the sound wave generator comprises an electrically powered sound wave transmitter, such as a beeper or a buzzer.

According to one aspect of the invention, the information transmission device comprises a haptic feedback device.

According to one aspect of the invention, the haptic feedback device is configured to generate a hard point when the reservoir moves from the disconnected position to the operating position.

For example, the haptic feedback device comprises a haptic feedback portion arranged in line with the guiding surface and presenting an inflection with respect to the guiding surface. The inflection with respect to the guiding surface generates a hard point.

A hard point is generated when, in the reservoir's travel from the disconnected position to the operating position, the user must apply more force to make the reservoir move into the operating position.

According to one aspect of the invention, the haptic feedback device comprises a motor designed to generate force feedback during the movement from the disconnected position to the operating position.

According to one aspect of the invention, the information transmission device comprises a visual interface.

According to one aspect of the invention, the visual interface comprises, for example, a screen or a light signal such as an LED.

According to one aspect of the invention, the mount comprises a contact portion intended to be positioned on a work surface and in which the reservoir is configured to be attached to the mount according to an insertion direction transverse to the contact portion.

Thanks to these provisions, the placement and removal of the reservoir is easier for the user. In fact, the placement and removal of the reservoir can be performed using only one hand.

According to one aspect of the invention, the contact portion comprises a reference surface, intended to be positioned substantially parallel to the work surface, the reservoir being configured to be attached to the mount according to an insertion direction that is inclined with respect to the contact portion.

According to one aspect of the invention, the reference surface is substantially flat.

According to one aspect of the invention, the contact portion is substantially flat.

According to one aspect of the invention, the contact portion comprises fastening elements intended to fix the mount to the work surface.

Thanks to these provisions, the mount can be fixed to the work surface, which allows the user to insert and remove the reservoir from the mount using only one hand.

According to one aspect of the invention, the fastening elements comprise at least one suction cup.

According to one aspect of the invention, the contact portion comprises contact elements, for example studs, intended to come into contact with the work surface when the base is placed on the work surface.

Preferably, the angle between the insertion direction and the contact portion, more specifically the angle between the insertion direction and the reference surface, is between 45° and 90°.

Thanks to these provisions, the ergonomics of the base are improved.

Preferably, the angle between the insertion direction and the contact portion, more specifically the angle between the insertion direction and the reference surface, is between 70° and 90°.

These provisions improve the ergonomic performances of the base.

Preferably, the angle between the insertion direction and the contact portion, more specifically the angle between the insertion direction and the reference surface, is between 80° and 90°.

These provisions improve the ergonomic performances of the base.

Preferably, the insertion direction is normal to the contact portion, more specifically the insertion direction is normal to the reference surface.

These provisions improve the ergonomic performances of the base.

According to another embodiment, the insertion direction is oblique with respect to the contact portion, more specifically with respect to the reference surface, that is, the insertion direction is neither parallel to the contact portion and/or reference surface, nor perpendicular to the contact portion and/or reference surface.

According to one aspect of the invention, the reservoir comprises a stop portion configured to bear against the mount according to the insertion direction.

Thanks to these provisions, the positioning of the reservoir on the mount is facilitated and the reservoir is kept in the operating position.

According to one aspect of the invention, the stop portion is substantially perpendicular to the insertion direction.

According to one aspect of the invention, the mount comprises a support portion configured to engage with the stop portion of the reservoir in order to hold the reservoir according to the insertion direction.

Thanks to these provisions, the positioning of the reservoir on the mount is facilitated and the reservoir is kept in the operating position.

According to one aspect of the invention, the mount comprises at least one guiding portion configured to guide the reservoir on the mount during its placement on the mount.

These provisions facilitate the placement of the reservoir on the mount and thus improve the ergonomics of the base.

According to one aspect of the invention, the reservoir comprises at least one guiding part configured to guide the placement of the reservoir on the mount.

These provisions facilitate the placement of the reservoir on the mount and thus improve the ergonomics of the base.

According to one aspect of the invention, the mount comprises at least one holding portion configured to hold the reservoir according to a holding direction that is inclined with respect to the insertion direction.

According to one aspect of the invention, the mount comprises at least one holding portion configured to hold the reservoir according to a holding direction perpendicular to the insertion direction.

Thanks to these provisions, the reservoir is kept on the mount in the operating position.

According to an alternative, the reservoir is configured to be attached to the mount according to an insertion direction substantially parallel to the contact portion.

According to one aspect of the invention, the reservoir comprises a housing to receive the fluid.

According to one aspect of the invention, the housing to receive the fluid comprises a fluid insertion opening.

"Fluid" refers to all types of fluid suitable for shaping hair, such as water or a mixture of water and hair care product.

According to one aspect of the invention, the reservoir comprises a closing element configured to be in a fluid insertion position in which the closing element provides access to the insertion opening, and a closed position in which the closing element obstructs the insertion opening. The closed position allows access to the insertion opening and thus allows fluid to be added to the reservoir.

According to one aspect of the invention, the housing to receive the fluid comprises an outlet opening. The reservoir comprises a closing element of the outlet opening.

According to one aspect of the invention, the closing element of the outlet opening comprises a valve.

According to one aspect of the invention, the reservoir is in fluid communication with the pump.

According to one aspect of the invention, the outlet opening comprises a sealing element in its periphery. Thus, when the reservoir is in the operating position, the fluid connection with the mount is sealed.

According to one aspect of the invention, the sealing element comprises a seal or a flexible wall made of silicone, for example.

This invention further concerns a hair styling appliance comprising:

- a base conforming to any one of the aforementioned characteristics;

a portable unit remote from the base;

a line that fluidically connects the base and the portable unit.

According to one aspect of the invention, the line electrically connects the base and the portable unit.

According to one aspect of the invention, the portable unit comprises two arms able to move in relation to one another, between a configuration where they are close together for treatment of hair and a configuration where they are apart for engagement of hair to be treated.

According to one aspect of the invention, at least one of the two arms comprises a hair treatment surface.

According to one aspect of the invention, at least one of the two arms comprises a heating element.

According to one aspect of the invention, at least one of the two arms comprises a steam dispensing system.

Other characteristics and advantages of this invention will be seen in light of the following description and by examining the attached figures, in which.

On all of these figures, identical or similar references designate identical or similar members or sets of members.

Figure 1:
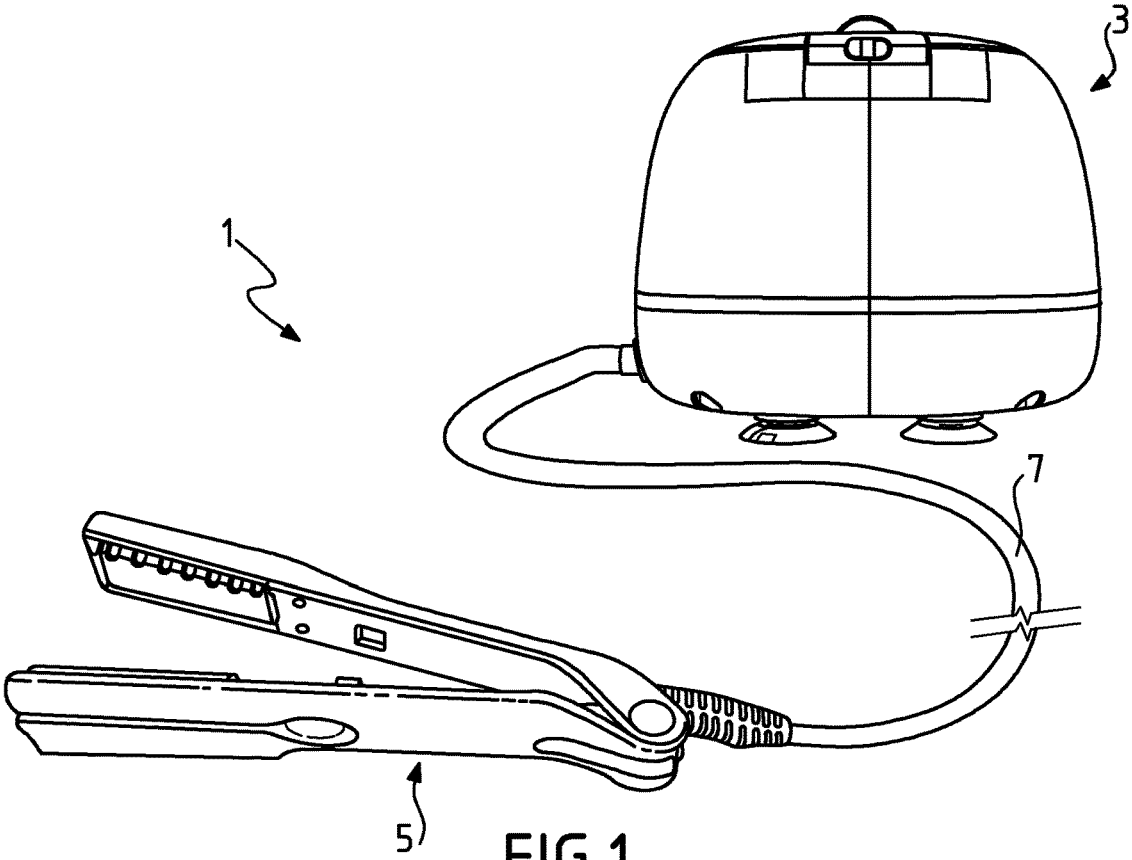
FIG. 1 represents a hair styling appliance.

FIG. 1 represents a hair styling appliance 1 comprising a base 3, a portable unit 5 remote from the base 3 and a line 7 that electrically and fluidically connects the base 3 and the portable unit 5.

Figure 2:
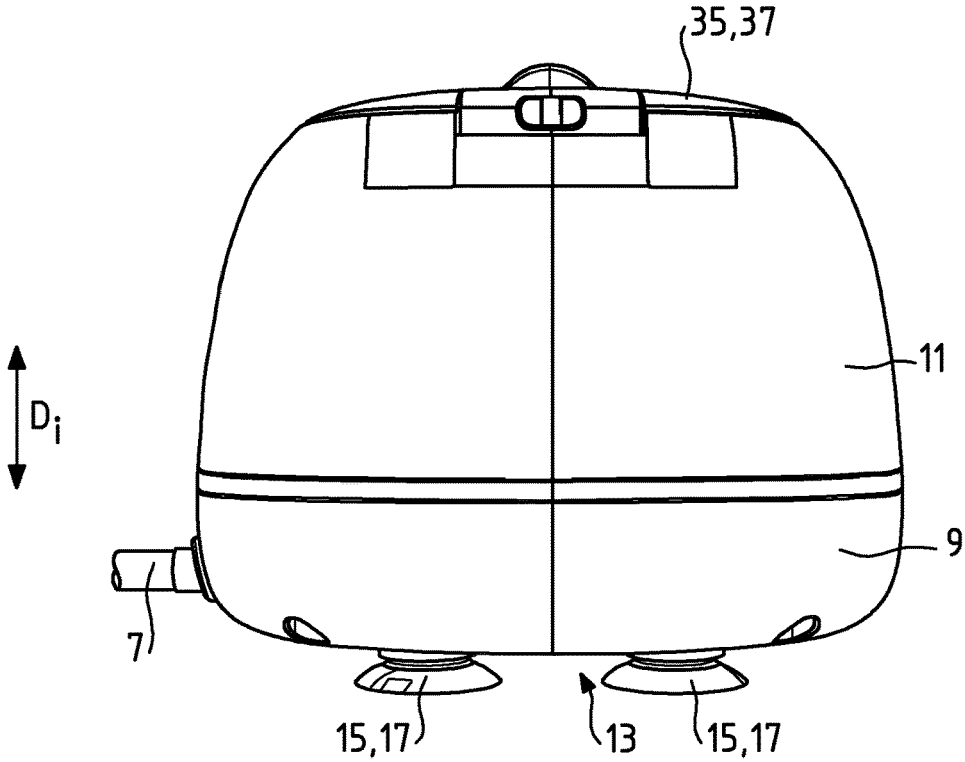
FIG. 2 represents a base of the hair styling appliance.

The base 3, represented in FIG. 2, comprises a mount 9 and a reservoir 11 designed to be attached to the member 9. The mount 9 comprises a contact portion 13 intended to be positioned on a work surface.

In this embodiment, the reservoir 11 is configured to be attached to the mount 9 according to an insertion direction DI that is inclined with respect to the contact portion 13.

The contact portion 13 comprises a substantially flat surface. The contact portion 13 further comprises fastening elements 15 intended to fix the mount 9 to the work surface. The fastening elements 15 each comprise a suction cup 17.

According to another embodiment, the contact portion 13 comprises studs. Preferably, the insertion direction DI is normal to the contact portion 13.

Figure 3:
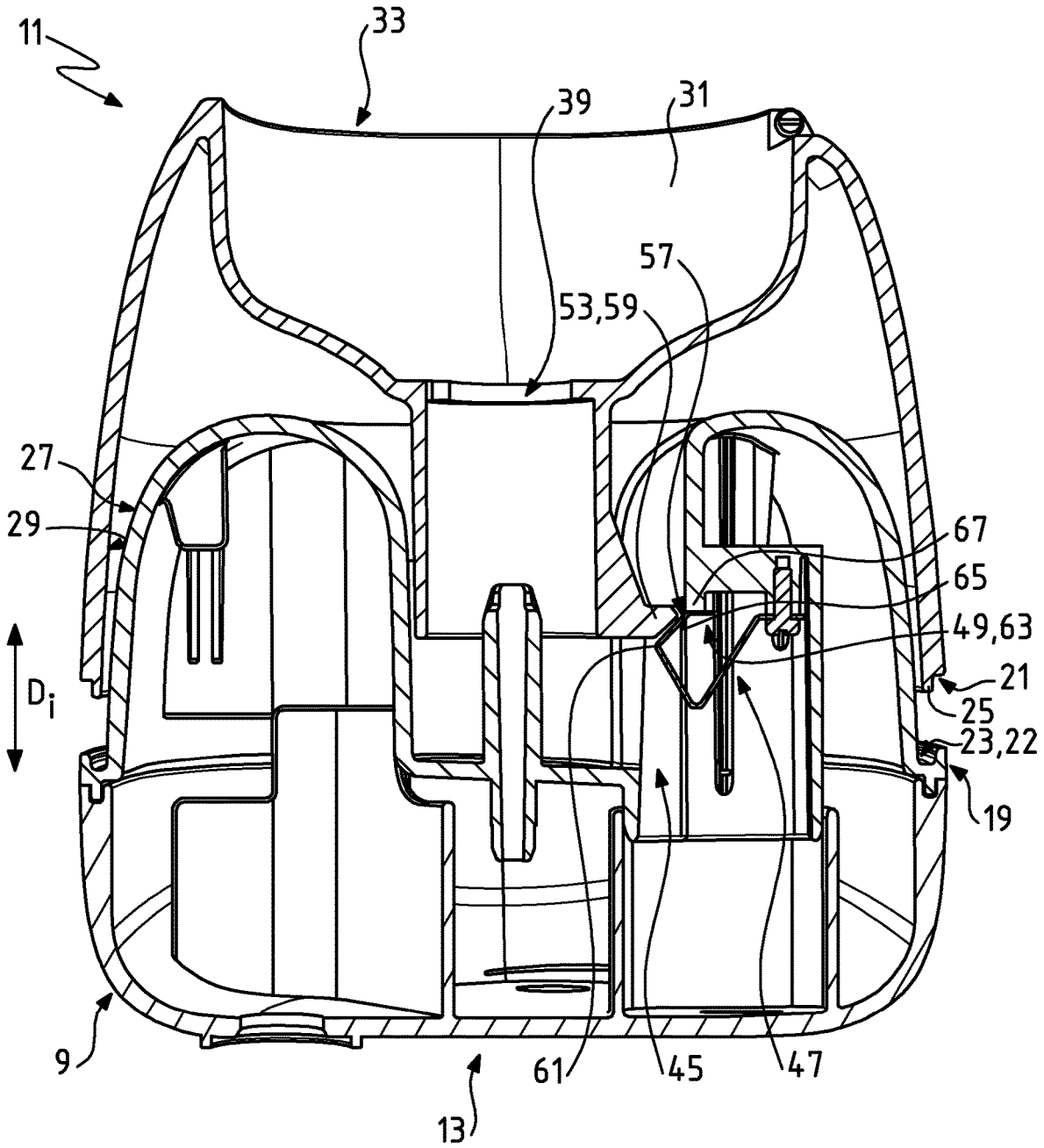
FIG. 3 represents a cross-section view of the base of the hair styling appliance when a reservoir of the base is in the disconnected position.
Figure 4:
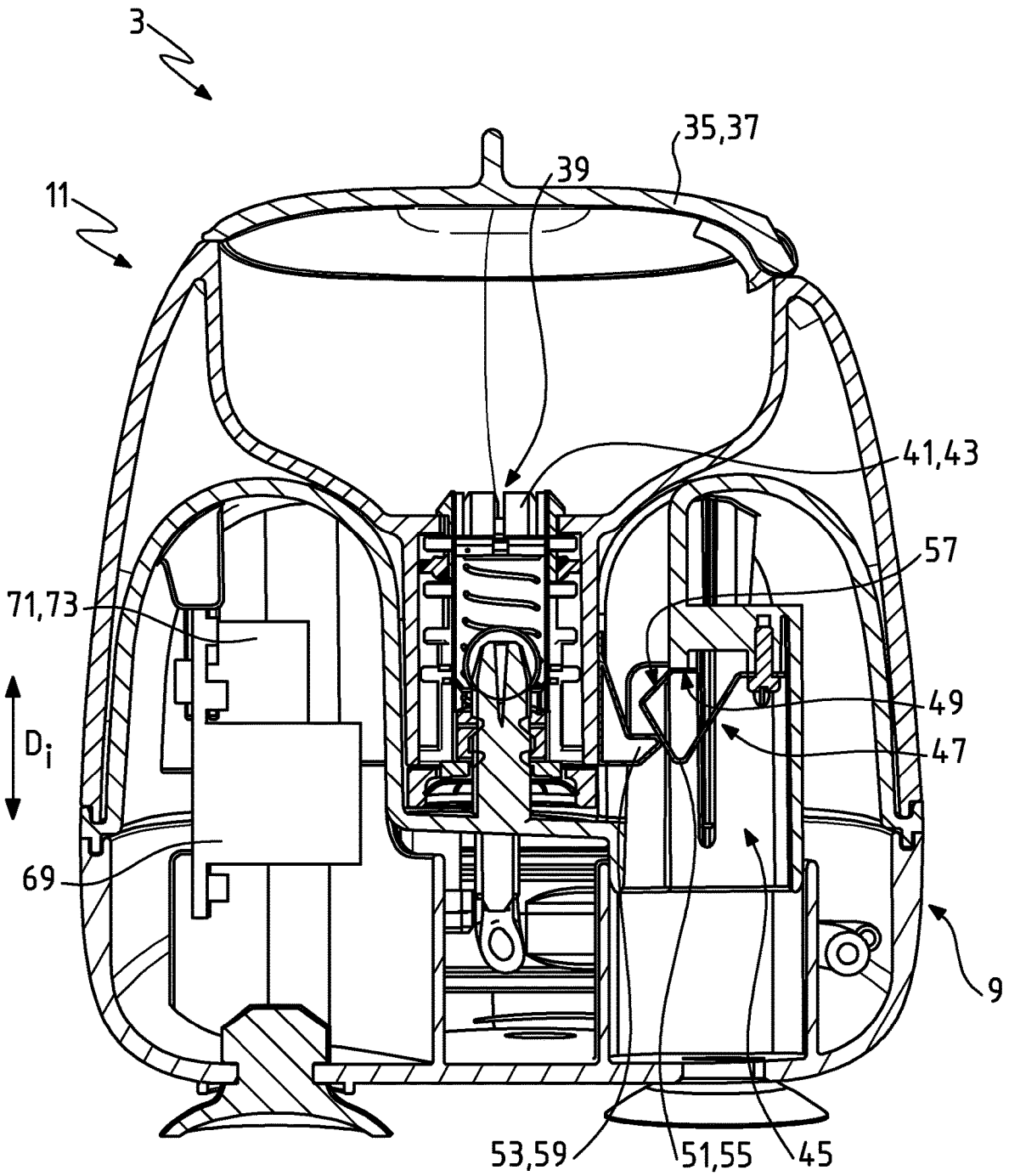
FIG. 4 represents a cross-section view of the base of the hair styling appliance when the reservoir is in the operating position.

The reservoir 11 is configured to be in a disconnected position, represented in FIG. 3, in which the reservoir 11 is away from the mount 9. The reservoir is further configured to be in an operating position, represented in FIG. 4, in which the reservoir 11 engages fluidically with the mount 9.

The reservoir 11 is configured to receive a fluid. When a user uses the hair styling appliance 1, if the reservoir 11 is empty, the user can remove the reservoir 11 from the mount 9 in order to fill it with fluid. The reservoir 11 is then in a disconnected position.

"Fluid" refers to all types of fluid suitable for shaping hair, such as water or a mixture of water and hair care product.

When the reservoir 11 is full, the user positions the reservoir 11 in the operating position. In the operating position, the reservoir 11 engages fluidically with the mount 9.

In the embodiment presented, the base 3 is substantially rounded. In fact, in the operating position, the mount 9 and the reservoir 11 are configured to fit together so that their external surfaces form a smooth external surface of the base 3, without interruption.

The mount 9 comprises a support portion 19. The reservoir 11 comprises a stop portion 21 configured to engage with the support portion 19 of the reservoir 11 to hold the reservoir 11 according to the insertion direction. The support portion 19 and the stop portion 21 engage along the circumference of the base 3.

The support and stop portions 19, 21 each comprise a part substantially perpendicular to the insertion direction DI.

The mount comprises a holding portion 22, here comprising a throat 23 along the external surface of the mount 9. The stop portion 21 comprises a protrusion 25 along the external surface of the reservoir 11. In the operating position, the throat 23 receives the protrusion 25.

In this way, the throat 23 is configured to hold the reservoir according to a holding direction that is inclined with respect to the insertion direction and preferably transverse to the insertion direction. The reservoir is kept on the mount in the operating position.

The mount 9 comprises a guiding portion 27 configured to guide the reservoir 11 on the mount 9 during its placement on the mount 9.

The reservoir 11 also comprises a guiding part 29 intended to slide against the guiding portion 27 of the mount 9 during the placement of the reservoir 11 on the mount 9. In this way, the placement of the reservoir on the mount is facilitated.

The reservoir 11 comprises a housing 31 to receive the fluid. The housing 31 to receive the fluid comprises a fluid insertion opening 33. The reservoir 11 comprises a closing element 35. The closing element comprises a lid 37 that is able to move in rotation in relation to the insertion opening 33. The lid 37 is configured to be in a fluid insertion position in which the lid 37 provides access to the insertion opening 33, and a closed position in which the lid 37 obstructs the insertion opening 33. The insertion position allows access to the insertion opening 33 and thus allows fluid to be added to the reservoir 11.

The housing 31 to receive the fluid comprises an outlet opening 39. The reservoir 11 comprises a closing element 41 of the outlet opening 39. The closing element 41 comprises a valve 43. The reservoir 11 is thus in fluid communication with the mount 9. The outlet opening 39 comprises a sealing element in its periphery. Thus, when the reservoir 11 is in the operating position, the fluid connection with the mount 9 is sealed. The sealing element comprises a seal or a flexible wall made of silicone, for example.

The base 3 further comprises a detection system 45 with a detector 47 configured to detect when the reservoir 11 moves from the disconnected position to the operating position. "Detector" refers to all types of proximity sensors, such as mechanical detectors, electrical contact detectors, magnetic or electromagnetic detectors, infrared radiation detectors.

The detection of the movement of the reservoir 11 from the disconnected position to the operating position is therefore accurate. The accuracy of this detection of the position of the reservoir 11 provides more safety for the user when putting the hair styling appliance 1, and more specifically the base 3, into operation. In addition, the detection system 45 makes it possible to reduce the risk of malfunctions and deterioration of the hair styling appliance 1.

The detection system 45 comprises an information transmission device 49 configured to communicate information to a user on the movement from the disconnected position to the operating position. The user is thus notified of the movement of the reservoir 11 from the disconnected position to the operating position. The information to the user is accurate and thus facilitates the use of the hair styling appliance 1.

The detector 47 is designed to transmit to the information transmission device 49 information on the movement from the disconnected position to the operating position.

According to the embodiment represented, the detector 47 comprises a detection member 51 able to move between a resting position and a biasing position, corresponding to the movement of the reservoir 11 from the disconnected position to the operating position. The detection member 51 here is a metal strip.

The detector 47 further comprises a biasing member 53 designed to move the detection member 51 between the resting position and the biasing position. The detector 47 here is mechanical, not subject to malfunctions associated with devices sensitive to aqueous media, such as electronic devices. The detection member 51 comprises a return element 55 designed to return the detection member 51 to the resting position. The return element 55 comprises an elastically deformable element. The return element 55 here consists of the elastically deformable metal strip. The detection member 51 is thus made in one piece with the return element 55.

According to another embodiment, the return element 55 may comprise a spring.

The detection member 51 comprises a guiding surface 57 of the biasing member 53. The biasing member 53 is designed to drive the detection member from the resting position to the biasing position, when the user puts the reservoir 11 on the mount 9.

In the embodiment represented, the biasing member 53 is integral with the reservoir 11. The biasing member 53 is made in one piece with the reservoir 11.

The biasing member 53 comprises a finger 59. The finger 59 is designed to engage with the guiding surface 57. The finger 59 is designed to slide along the guiding surface 57 in order to drive the detection member 51 from the resting position to the biasing position.

The guiding surface 57 comprises an extremity portion 61. When the finger 59 slides on the guiding surface 57 and reaches the extremity portion 61, the detection member 51 is in the biasing position. The finger 59 then crosses the extremity portion 61 and the return element 55 returns the detection member 51 to the resting position.

According to the embodiment represented, the information transmission device 49 comprises a sound wave generator 63.

The sound wave generator 63 is designed to transmit a sound wave when the reservoir 11 moves from the disconnected position to the operating position. The sound wave generator 63 comprises a movable part 65 and a fixed part 67. The movable part 65 is designed to come into contact with the fixed part 67 in order to cause a click generating a sound wave.

The metal strip consists of the movable part 65. The movable part is thus made in one piece with the detection member 51. The fixed part 67 is made in one piece with the mount 9. When the return element 55 returns the detection member 51 to the resting position, the movable part 65 comes into contact with the fixed part 67, which generates a click.

The mount 9 further comprises a pump 69. The pump 69 comprises a pump actuator 71. In the embodiment represented, the pump actuator 71 consists of a motor 73.

According to one embodiment, the detector 47 may comprise a control interface configured to control the information transmission device 49.

According to another embodiment of the invention, the detector 47 comprises a magnetic element. The detector 47 may, for example, comprise a magnetic switch or a Hall effect sensor.

According to another embodiment of the invention, the detector 47 is optical and comprises a wave transmitter and a wave receiver, for example infrared.

According to another embodiment, the base comprises a fluid suction/discharge device, the detection system comprising a control interface configured to control the suction/discharge device in order to prevent the suction/discharge device from starting up when the reservoir is in the disconnected position.

In this way, if the reservoir is not in sealed fluid communication with the mount, the suction/discharge device cannot start up. The risks of damage to the device are thus limited.

More specifically, the mount comprises the suction/discharge device.

The control interface is configured to control the suction/discharge device in order to permit the suction/discharge device to start up when the reservoir is in the operating position, and more specifically when the detector detects the movement of the reservoir from the disconnected position to the operating position.

According to an optional aspect of this embodiment, the control interface is configured to start up the suction/discharge device when the reservoir is in the operating position, and more specifically when the detector detects the movement of the reservoir from the disconnected position to the operating position.

The detector is designed to transmit to the suction/discharge device information on the movement from the disconnected position to the operating position.

According to the embodiment represented, the suction/discharge device consists of the pump 69. The control interface is thus configured to control the pump actuator 71.

According to another embodiment of the invention, the sound wave generator 63 comprises an electrically powered sound wave transmitter, such as a beeper or a buzzer.

According to another embodiment of the invention, the information transmission device 49 comprises a haptic feedback device. The haptic feedback device is configured to generate a hard point when the reservoir moves from the disconnected position to the operating position. For example, the haptic feedback device comprises a haptic feedback portion arranged in line with the guiding surface and presenting an inflection with respect to the guiding surface. This inflection generates a hard point. A hard point is generated when, in the reservoir's travel from the disconnected position to the connected position, the user must apply more force to make the reservoir move into the operating position. The haptic feedback device may also comprise a motor designed to generate force feedback during the movement from the disconnected position to the operating position.

According to another embodiment of the invention, the information transmission device 49 comprises a visual interface. The visual interface comprises, for example, a screen or a light signal such as an LED.

Of course, this invention is not limited to the embodiments described and represented, which are provided for illustrative purposes and are not restrictive.

The invention claimed is:

1. A hair styling appliance comprising:

a base comprising:

a mount;

a removable reservoir configured to be in a disconnected position in which the reservoir is away from the mount, and an operating position in which the reservoir engages fluidically with the mount, a portable unit remote from the base;

a line that fluidically connects the base and the portable unit;

wherein the base further comprises a detection system with a detector configured to detect the movement of the reservoir from the disconnected position to the operating position, and wherein the detector comprises:

a detection member configured to move between a resting position and a biasing position, corresponding to the movement of the reservoir from the disconnected position to the operating position; and a biasing member configured to move the detection member between the resting position and the biasing position.

2. The hair styling appliance according to claim 1, wherein the detection system comprises an information transmission device configured to communicate information to a user on the movement of the reservoir from the disconnected position to the operating position.

3. The hair styling appliance according to claim 2, wherein the information transmission device comprises a sound wave generator configured to transmit a sound wave when the reservoir moves from the disconnected position to the operating position.

4. The hair styling appliance according to claim 1, wherein the base comprises a fluid suction/discharge device, the detection system comprising a control interface configured to prevent the suction/discharge device from starting up.

5. The hair styling appliance according to claim 1, wherein the detection member comprises a return element configured to return the detection member to the resting position.

6. The hair styling appliance according to claim 1, wherein the mount comprises a contact portion configured to be positioned on a work surface and wherein the reservoir is configured to be attached to the mount according to an insertion direction transverse to the contact portion.

7. The hair styling appliance according to claim 1, wherein the portable unit comprises two arms configured to move in relation to one another, between a configuration where they are close together for treatment of hair and a configuration where they are apart for engagement of hair to be treated.

8. A hair styling appliance comprising:

a base comprising:

a mount;

a removable reservoir configured to be in a disconnected position in which the reservoir is away from the mount, and an operating position in which the reservoir engages fluidically with the mount, a portable unit remote from the base;

a line that fluidically connects the base and the portable unit;

wherein the base further comprises a detection system with a detector configured to detect the movement of the reservoir from the disconnected position to the operating position, and wherein the detector comprises a magnetic element or a wave transmitter and a wave receiver.

9. A hair styling appliance comprising:

a base comprising:

a mount;

a removable reservoir configured to be in a disconnected position in which the reservoir is away from the mount, and an operating position in which the reservoir engages fluidically with the mount, a portable unit remote from the base;

a line that fluidically connects the base and the portable unit;

wherein the base further comprises a detection system with a detector configured to detect the movement of the reservoir from the disconnected position to the operating position, wherein the detection system comprises an information transmission device configured to communicate information to a user on the movement of the reservoir from the disconnected position to the operating position, wherein the information transmission device comprises a sound wave generator configured to transmit a sound wave when the reservoir moves from the disconnected position to the operating position, and wherein the sound wave generator comprises a movable part and a fixed part arranged opposite the movable part, the movable part being configured to come into contact with the fixed part in order to produce a click.

10. The hair styling appliance according to claim 9, wherein the detection member comprises a return element configured to return the detection member to the resting position, and wherein the movable part is integral with the return element.

11. A hair styling appliance comprising:

a base comprising:

a mount;

a removable reservoir configured to be in a disconnected position in which the reservoir is away from the mount, and an operating position in which the reservoir engages fluidically with the mount, a portable unit remote from the base;

a line that fluidically connects the base and the portable unit;

wherein the base further comprises a detection system with a detector configured to detect the movement of the reservoir from the disconnected position to the operating position, wherein the detection system comprises an information transmission device configured to communicate information to a user on the movement of the reservoir from the disconnected position to the operating position, and wherein the information transmission device comprises a haptic feedback device and/or a visual interface.

* * * * *